US010243264B2

(12) United States Patent
Foore et al.

(10) Patent No.: US 10,243,264 B2
(45) Date of Patent: Mar. 26, 2019

(54) PIT LID TRIDENT ANTENNA ARRANGEMENT

(71) Applicant: Aclara Technologies LLC, Hazelwood, MO (US)

(72) Inventors: Lawrence R. Foore, Bay Village, OH (US); Gary D. Mattox, Bedford, OH (US)

(73) Assignee: Aclara Technologies LLC, St. Louis, MO (US)

( * ) Notice: Subject to any disclaimer, the term of this patent is extended or adjusted under 35 U.S.C. 154(b) by 0 days.

(21) Appl. No.: 15/257,624

(22) Filed: Sep. 6, 2016

(65) Prior Publication Data

US 2017/0077598 A1 Mar. 16, 2017

Related U.S. Application Data

(60) Provisional application No. 62/217,560, filed on Sep. 11, 2015.

(51) Int. Cl.

| | |
|---|---|
| ***H01Q 5/392*** | (2015.01) |
| ***H01Q 1/42*** | (2006.01) |
| ***H01Q 1/48*** | (2006.01) |
| ***H01Q 1/38*** | (2006.01) |
| ***H01Q 1/22*** | (2006.01) |
| ***H01Q 9/04*** | (2006.01) |

(52) U.S. Cl.

CPC ..... *H01Q 1/42* (2013.01); *H01Q 1/2233* (2013.01); *H01Q 1/38* (2013.01); *H01Q 1/48* (2013.01); *H01Q 5/392* (2015.01); *H01Q 9/0421* (2013.01)

(58) Field of Classification Search

CPC ..... H01Q 5/378; H01Q 5/385; H01Q 5/392; H01Q 1/42; H01Q 9/0421; H01Q 1/2233; H01Q 1/48; H01Q 1/38

USPC ..... 343/751, 826, 817, 833, 834

See application file for complete search history.

(56) References Cited

U.S. PATENT DOCUMENTS

| | | | | |
|---|---|---|---|---|
| 2002/0070902 | A1* | 6/2002 | Johnson | H01Q 1/243 343/702 |
| 2004/0227683 | A1* | 11/2004 | Caimi | H01Q 1/36 343/742 |
| 2006/0226325 | A1* | 10/2006 | Cook | G01F 15/063 248/316.8 |
| 2012/0274538 | A1* | 11/2012 | Tsou | H01Q 1/243 343/876 |
| 2013/0307742 | A1* | 11/2013 | Hu | H01Q 1/243 343/821 |

(Continued)

OTHER PUBLICATIONS

The ARRL Antenna Book, by Gerald Hall.*

*Primary Examiner* — Hoang V Nguyen
*Assistant Examiner* — Awat M Salih
(74) *Attorney, Agent, or Firm* — Sandberg Phoenix & von Gontard, P.C.

(57) ABSTRACT

A trident antenna arrangement (300) is described. The antenna arrangement includes a driving element (302), a first parasitic element (304), a second parasitic element (306), a feed point (308), and a ground plate (309) disposed on a substrate (310). The parasitic elements have different lengths which causes a dual resonance. Operation of the driving element and parasitic elements over the substrate and the ground plate allows the antenna system to be minimally impacted by the conductive material underneath. The antenna arrangement is used to transmit water meter (110) readings from a remote location to a utility.

20 Claims, 3 Drawing Sheets

(56) References Cited

U.S. PATENT DOCUMENTS

2015/0084817 A1* 3/2015 Yong ..... H01Q 1/243
343/702

* cited by examiner

400

PIT LID TRIDENT ANTENNA ARRANGEMENT

CROSS REFERENCE TO RELATED APPLICATIONS

This application is based upon and claims the benefit of U.S. provisional patent application 62/217,560 filed Sep. 11, 2015.

STATEMENT REGARDING FEDERALLY SPONSORED RESEARCH OR DEVELOPMENT

N/A

BACKGROUND OF THE INVENTION

The present invention relates to antenna systems for communicating utility meter readings. In particular, but not exclusively, the present invention relates to a trident antenna arrangement associated with a utility meter, particularly a water meter, for remotely transmitting meter readings from a generally underground pit box in which the antenna is installed to a remote receiver.

In an effort to alleviate the problems associated with physically reading utility meters, utility companies have deployed remote meter transmission units. In general, a remote meter transmission unit remotely reads a utility meter and transmits the meter readings or other meter related information, directly or indirectly, back to a utility company. The remote meter transmission units transmit these meter readings, via radio frequency (RF) signals, to a central reading station or data collection unit. In some instances, the RF signal is transmitted over relatively long distances; e.g., a mile or more. Thus, a remote meter transmission unit may require a robust antenna capable of transmitting the meter readings the necessary distances.

The amount of RF energy actually irradiated into the air, as compared with the potential energy that could be radiated is based on a number of factors. These include applied voltage, the amount of current flowing through the antenna, the frequency of the rf signal applied to the antenna, the material from which the antenna is made, the antenna's geometry, and those materials in surrounding space relatively close to the antenna (e.g., a sphere-radius of up to a few wavelengths of the rf signal applied to the antenna). When the space surrounding an antenna varies, the antenna's performance (i.e., the amount of energy radiated therefrom) will correspondingly vary.

Various factors to be considered in designing and implementing an integrated antenna system include, without limitation:

frequency of operation;

transmitter output power;

antenna gain, polarization, characteristic impedance, geometry, and radiation pattern;

azimuth beam-width and variation;

coefficient of maximum wave reflection;

location where the antenna will be installed;

ability to effect antenna installation;

desired length of service;

ability to operate in exposed environmental conditions (such as exposure to water) with only very small variations in operation performance (due to any water absorption into the antenna system);

resistance to ultra-violet light;

shock and vibration resistance;

environmental temperature variability resistance; and, government regulations for operating radio equipment.

At the same time, the utility must be aware of cost factors and the ability to manufacture a large volume of such units (for use in a full system having a number of meter reading locations) that are reliable and exhibit repeatability of performance.

BRIEF SUMMARY OF THE INVENTION

According to one aspect, an antenna used for transmitting utility usage data includes a substrate and a ground plate disposed on the substrate. The antenna has a driving element that adheres to the substrate and is electrically connected to the ground plate. This driving element includes a feed point which an input current signal is supplied. The antenna includes a first parasitic element and a second parasitic element both of which adhere to the substrate and are electrically connected to the driving element and ground plate. The first parasitic element is of a first length and the second parasitic element is of a second and different length. The parasitic elements are responsive to the input signal to generate a dual resonance output.

Other objects and features will be in part apparent and in part pointed out hereinafter.

BRIEF DESCRIPTION OF THE SEVERAL VIEWS OF THE DRAWINGS

The accompanying figures, together with the detailed description which follows, form part of the specification and illustrate the various embodiments described in the specification.

Corresponding reference characters indicate corresponding parts throughout the drawings.

DETAILED DESCRIPTION OF INVENTION

Figure 1A:
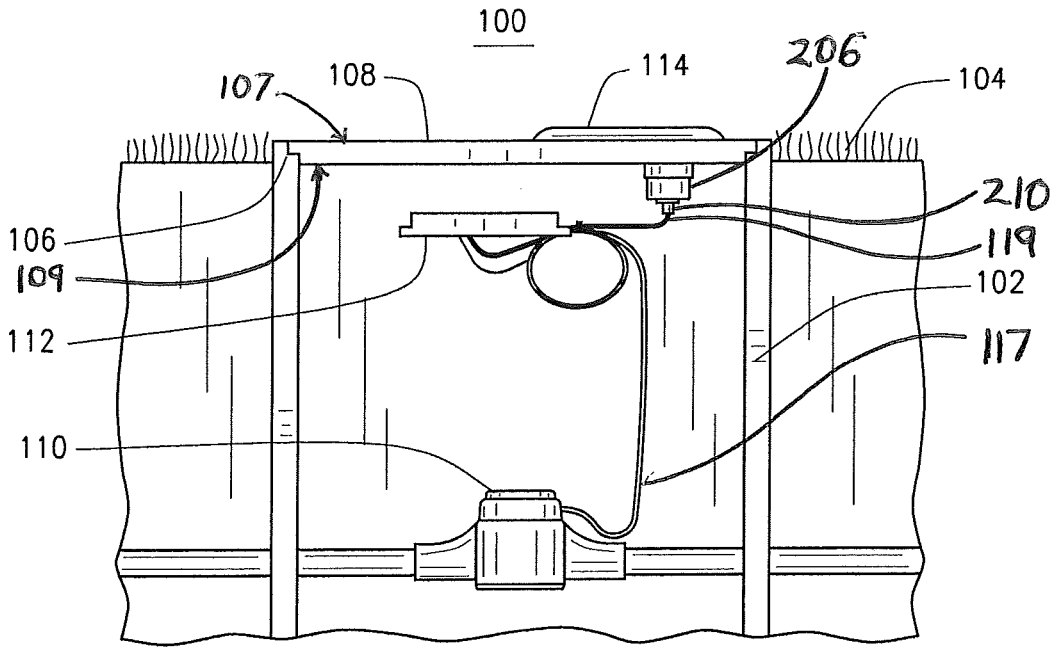
FIG. 1A is a diagram illustrating components of an exemplary antenna arrangement of the invention together with features of a conventional pit box in which the arrangement is installed.

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Referring to the drawings, FIG. 1A is a cross-sectional view of an antenna arrangement 100 installed in a conventional pit box 102. As is described hereinafter, components of the exemplary embodiment of an antenna arrangement 100 cooperate and interact with features of pit box 102. As shown in FIG. 1A, pit box 102 extends below a ground surface 104 and is typically a cylindrical, metal enclosure that is substantially installed below ground level. The pit box 102 includes an upper ledge 106 that supports a pit lid 108. The pit lid 108 is preferably formed of metallic material; e.g., steel, cast iron, or from various other materials such as plastic or concrete. Pit lid 108 includes an upper surface 107 and a lower surface 109. Pit lid 108 and pit box 102 together enclose a utility meter 110, such as a water meter.

Figure 1B:
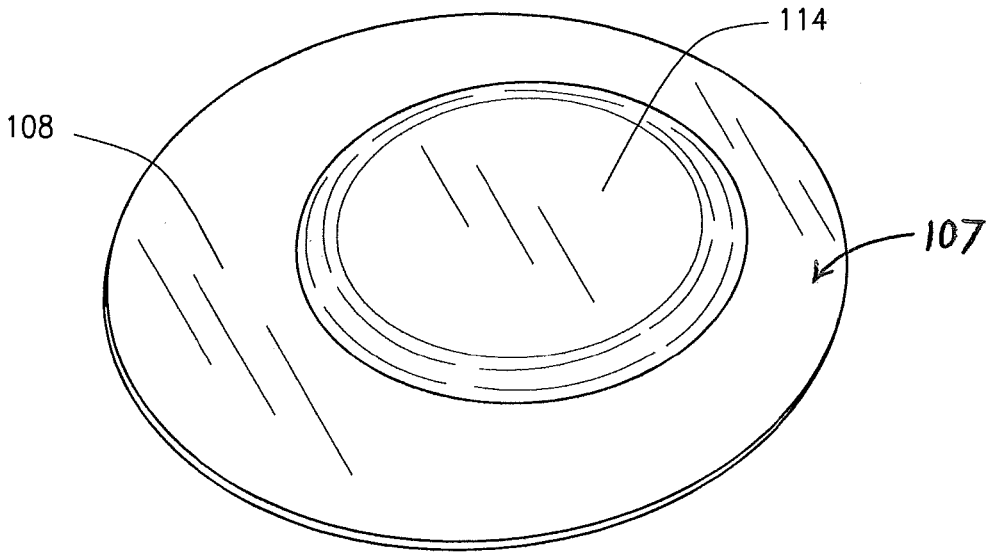
FIG. 1B is a diagram illustrating a top view of an antenna component mounted to a conventional pit lid.

A meter transmission unit (MTU) 112 attached to water meter 110 receives volumetric flow data from the meter 110 via wired connection 117. For example, in some aspects, meter 110 is outfitted with at least one sensor (not shown) to detect rotational movement of components within the meter 110 which action produces an electrical signal in the wired connection 117 representing a measurement of the volume of a commodity (e.g., water) flowing through the meter 110. MTU 112 is also electrically and/or communicatively coupled, via antenna connection 119 to an antenna feed conductor 213 of a cable 210, to an antenna component 114 of antenna arrangement 100 to transmit meter measurements over a Federal Communications Commission (FCC) licensed wireless channel. This communications channel is, for example, at 460 MHz Antenna component 114 is designed to be adaptively integrated with and/or mounted to pit lid 108, this being as shown in FIG. 1B.

Figure 2:
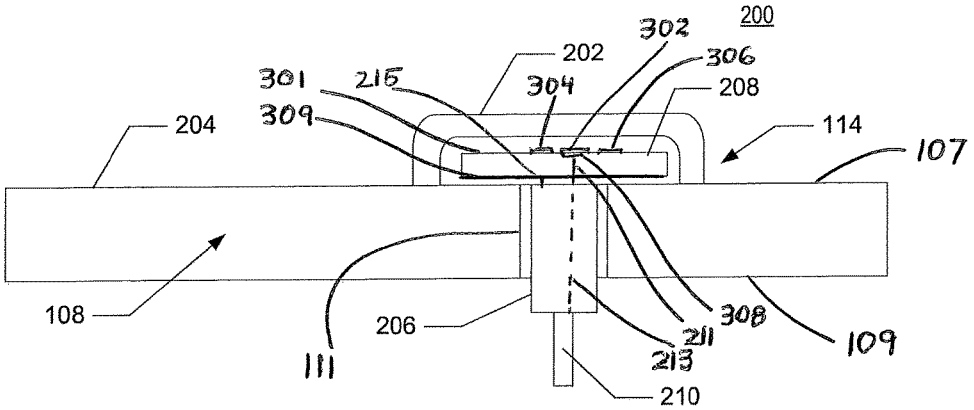
FIG. 2 is a cross-sectional view of the antenna component and pit lid.

Referring to the cross-sectional view 200 shown in FIG. 2, antenna component 114 includes a housing 202 supported on a top surface 107, 204 of pit lid 108. Antenna component 114 includes an extension member 206 that extends vertically through hole 111 of pit lid 108 to enable the antenna component 114 to be secured in place using any convenient means of securement. For example, as shown in FIGS. 1A and 2, extension member 206 may include threads onto which a retaining nut is threaded to secure the antenna component 114 in place. Antenna component 114 further includes an antenna 208 that is driven or excited by a current from MTU 112 so to generate and broadcast a rf signal that is detected and read at a remote location such as a data collection unit (not shown). According to one aspect, antenna component 114 includes a cable 210; for example, a rf coaxial cable, to facilitate a wired connection with MTU 112, such a connection, as is well-known in the art, having first and second conductors.

Figure 3:
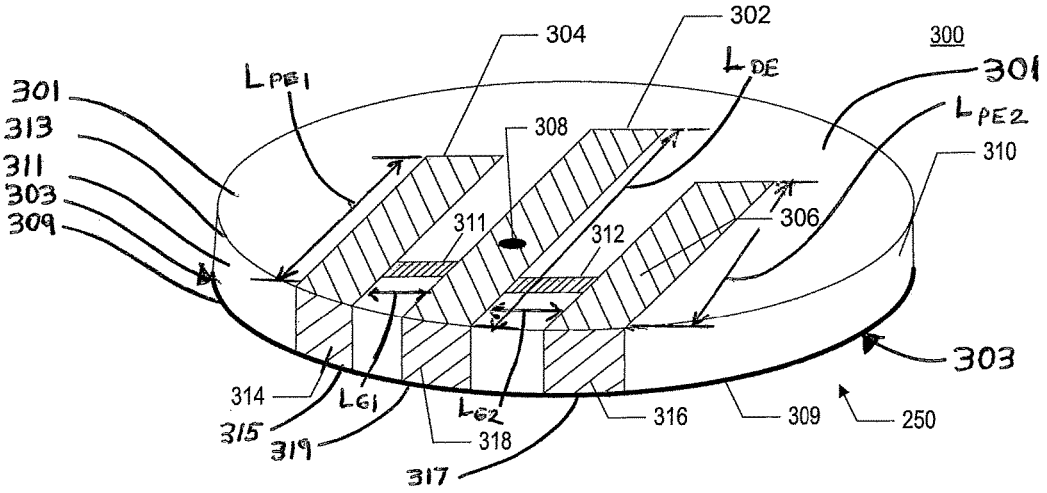
FIG. 3 is an isometric view of an exemplary trident antenna according to an aspect of the antenna arrangement; and, FIG. 4 is a return loss graph illustrating reflection loss as a function of the frequency of the trident antenna.

FIG. 3 an isometric view of an antenna 300 (e.g., antenna 208) according to an aspect of the invention as shown in FIG. 2. Antenna 300 is, for example, a trident antenna that includes a driving element 302, a first parasitic element 304, a second parasitic element 306, a feed point 308, and a ground plate 309 disposed on a substrate 310. The substrate 310 has a top surface 301, a bottom surface 303, one or more sides 311 and a top side edge 313. A ground plate 309 is disposed on bottom surface 303 of substrate 310. As shown and described, feed point 308 receives an electrical signal via substrate conductor 211 from antenna feed conductor 213 that is electrically coupled to a first conductor of cable 210. As referred to as a "trident antenna", driving element 302 receives the electrical signal via feed point 308 disposed on top surface 301 of the substrate 310. Driving element 302 is formed by an electrically conductive material disposed on top surface 301 of the substrate 310 to have an elongated planar shape of length $L_{DE}$. Driving element 302 has a first linear side and a second linear side that define a width therebetween, and has a first end and a second end. The first end of driving element 302 can be a free end that extends onto the top surface 301 inward away from the substrate top edge 313 with the second end being position proximal to the substrate top edge 313. First parasitic element 304 is formed by an electrically conductive material disposed on top surface 301 to have an elongated planar shape of length $L_{PE1}$. Second parasitic element 306 is formed by an electrically conductive material disposed on top surface 301 to have an elongated planar shape of length $L_{PE2}$. First parasitic element 304 is positioned parallel to a first side of driving element 302 and is spaced apart therefrom by a first gap length $L_{G1}$ and has a first end that extends onto the top surface 301 of the substrate 310 away from the top edge 313 and a second end that is proximal to the edge 313. Second parasitic element 306 is positioned parallel to a second side of driving element 302 and is spaced apart therefrom by a second gap length $L_{G2}$ with the second side being on the opposing side of driving element 302 from the first side thereof. The second parasitic element 306 has a first end that extends onto the top surface 301 of the substrate 310 away from the top edge 313 and a second end that is proximal to the edge 313. As shown, while all three components forming the trident antenna, i.e., the driving element 302, the first parasitic element 304 and the second parasitic element 306, are all planar elements with linear sides and are parallel to one another as disposed on top surface 301 of substrate 310, the lengths of each can be different. As shown in FIG. 3, the length $L_{DE}$ of driving element 302 can be greater than the length $L_{PE1}$ of first parasitic element 304 and can also be greater than the length $L_{PE2}$ of second parasitic element 306. Further, as also shown, the length $L_{PE1}$ of first parasitic element 304 can be less than or greater than the length $L_{PE2}$ of second parasitic element 306. Further as shown, the shapes of driving element 302, first parasitic element 304 and second parasitic element 306 can be elongated rectangles.

The material from which driving element 302, first parasitic element 304, second parasitic element 306, and ground plate 309 are formed is an electrically conductive material which is disposed on substrate 310. This material includes, for example, copper, brass, or aluminum. Driving element 302, first parasitic element 304 and second parasitic element 306, and the ground plate 309 all are adhered to substrate 310 by, for example, etching them onto the substrate 310 or inking them onto the substrate 310.

Substrate 310 is a dielectric substrate. For example, the substrate may be a printed circuit board (PCB) made of a fiberglass reinforced epoxy resin (FR4), a Bismaleimide-triazine (BT) resin, or any other nonconductive or insulating material.

The first conductor (not shown) of cable 210 of antenna component 114 is electrically coupled to driving element 302 at feed point 308 via a substrate conductor 211 and an antenna feed conductor 213 in order to receive an input current signal from MTU 112. A second conductor 215 electrically couples the second conductor (not shown) of the cable 210 to ground plate 309 of the antenna component 114 which forms the bottom surface 303 of substrate 310.

The first and second parasitic elements 304, 306 are each connected to driving element 302 though traces 311, 312, respectively, across the respective gaps lengths $L_{G1}$ and $L_{G2}$, to effect a short circuit connection between each of the parasitic elements 304, 306 and driving element 302. The first and second parasitic elements 304, 306 are connected to ground plate 309 through traces 314, 316, respectively, at respective connection points 315, 317, to establish a short circuit connection between each of the parasitic elements and ground plate 309. Similarly, driving element 302 is connected to ground plate 309 through a trace 318, at connection point 319, to establish a short circuit connection between the driving element 302 and the ground plate 309. As shown, edge traces 314, 316 and 318 connect with respective disposed first parasitic element 304, driving element 302, and second parasitic element 306 at top edge 313 and on the side 311 of the substrate 310 to make this short circuit connection to the ground plate 309 disposed on the bottom surface 303 of the substrate 310.

According to one aspect, parasitic elements 304, 306 have slightly different lengths wherein $L_{PE1}$ is not equal to $L_{PE2}$, which results in a dual resonance on the two opposing sides of the driving element 302 in response to the driving element 302 receiving an input current signal received at feed point 308. For example, if the differential length between $L_{PE1}$ and $L_{PE2}$ of the two parasitic elements is 0.090 inches, dual resonances occur which result in there being less than 10 dB of return loss when operating in a frequency range from 450 MHz to 470 MHz. The dual resonances are close in frequency which produces a wide bandwidth aggregate response. According to one aspect, there two resonant peaks will result which are sufficiently close together so to efficiently radiate over at least 4.35% of the RF carrier bandwidth.

Figure 4:
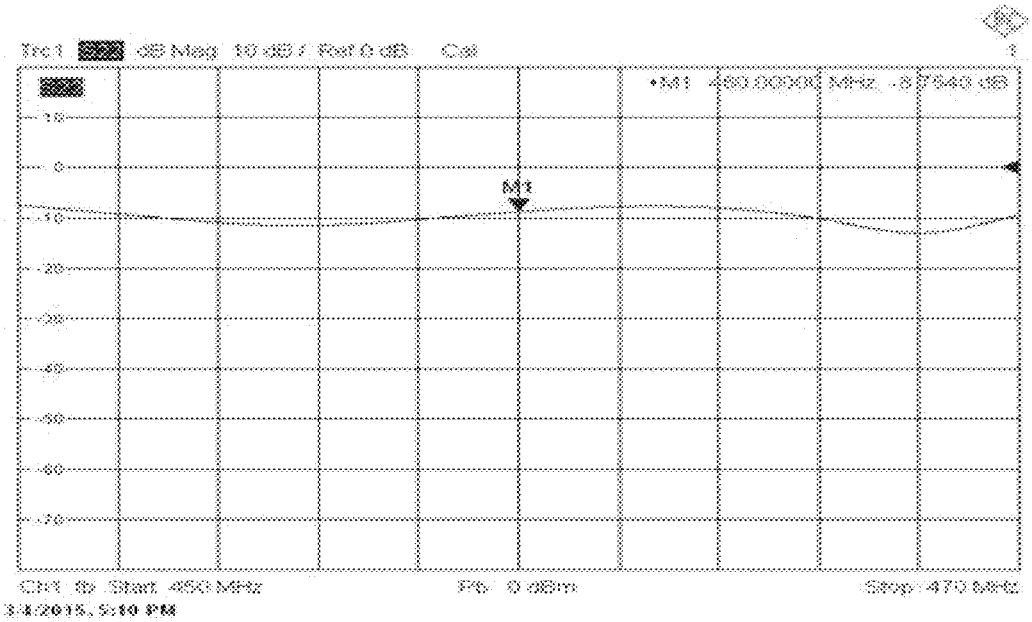

FIG. 4 presents a return loss graph 400 illustrating reflection loss with respect to frequency for the trident antenna arrangement 300 of FIG. 3. The return loss of the antenna 300 may refer to either reflection loss with respect to a frequency of antenna 300, or the difference in power (expressed in decibels (dB)) between input power and power reflected back by the load due to a mismatch.

As shown in FIG. 4, the super-imposed radiation pattern of the dual parasitic antenna arrangement 300, resonated in the far field, present a nearly uniform azimuth radiation pattern, which is shown as a nearly uniform reflection loss of about 10 dB across the operating frequency bandwidth from 450 MHz to 470 MHz. The operation of driving element 302 and parasitic elements 304, 306 over substrate 310 and ground plate 309 allows antenna arrangement 300 to be minimally impacted by the conductive material underneath.

For purposes of illustration, programs and other executable program components, such as the operating system, are illustrated herein as discrete blocks. It is recognized, however, that such programs and components reside at various times in different storage components of a computing device, and are executed by a data processor(s) of the device.

In view of the above, it will be seen that several advantages of the aspects of the invention are achieved and other advantageous results attained.

Having thus described the invention, what is claimed and desired to be secured by Letters Patent is:

1. An antenna component comprising:

a substrate composed of a dielectric material having a top surface and a bottom surface;

a ground plate composed of an electrically conductive material disposed on the bottom surface of the substrate;

a driving element composed of an electrically conductive material disposed on the top surface of the substrate and having an elongated planar shape with first and second ends, first and second linear sides defining a width therebetween, and a driving element length, the driving element further being electrically coupled to the ground plate and having a feed point to receive an input current signal from an external electrical source;

a first parasitic element composed of an electrically conductive material disposed on the top surface of the substrate and having an elongated planar shape with first and second ends, first and second linear sides defining a width therebetween, and a first parasitic length, the first parasitic element being parallel to and spaced apart from the first linear side of the driving element by a first gap, the first parasitic element being electrically coupled to the ground plate and being electrically connected to the driving element across the first gap through the dielectric substrate;

a second parasitic element composed of an electrically conductive material disposed on the top surface of the substrate and having an elongated planar shape having first and second ends, first and second linear sides defining a width therebetween, and a second parasitic length, the second parasitic element being parallel to and set apart from the second linear side of the driving element by a second gap, the second parasitic element being electrically connected to the driving element across the second gap through the dielectric substrate and being electrically coupled to the ground plate, wherein the second parasitic element length is of a different length than the first parasitic length, the first and second parasitic elements being responsive to the input signal to generate a dual resonance; and, wherein the driving element, the first parasitic element and the second parasitic element form a trident antenna arrangement; and wherein the differential length between the first parasitic length and the second parasitic length is approximately 0.090 inches, and the resulting dual resonances which occur resulting in a nearly uniform return loss that is 10 dB or less when the antenna arrangement operates in a frequency range of between approximately 450 MHz to approximately 470 MHz.

2. The antenna component of claim 1 wherein the substrate comprises a printed circuit board to which the ground plate is disposed by attachment thereto.

3. The antenna component of claim 1 which is installed on a pit lid having a top surface and a bottom surface, the pit lid being supported by a pit box which extends below a ground surface, the pit box comprising a, metal enclosure having an upper ledge supporting the pit lid, the pit box and pit lid together enclosing a utility meter, the pit lid having a through hole cavity and the antenna arrangement having a cavity enclosing the substrate and ground plate, and having an extension member having an electrical cable that extends vertically through the hole cavity, the housing configured for securement to the pit lid.

4. The antenna component of claim 3 in which the utility meter is a water meter.

5. The antenna component of claim 3 further including a meter transmission unit electrically connected to the utility meter and being the external electrical source, the meter transmission unit being electrically and/or communicatively coupled to an antenna component of the antenna arrangement so to transmit meter measurements over a FCC licensed wireless channel operating at the frequency range of between approximately 450 MHz to approximately 470 MHz, and the antenna component being integrated with and/or mounted to the pit lid.

6. The antenna component of claim 4 further comprising a housing selectably mountable to the top surface of the pit lid, and an extension member extending from the housing through a hole in the pit lid to enable the antenna component to be secured in place and for the passing of an electrical cable for transmitting of the input current signal to the feed point of the driving element from the external electrical source.

7. The antenna component of claim 1 wherein one or more of the driving element, the first parasitic element, the second parasitic element, and the ground plate elements is composed of an electrically conductive material selected from the group consisting of copper, brass, or aluminum.

8. The antenna component of claim 1 wherein one or more of the driving element, the first parasitic element, the second parasitic element, and the ground plate are all disposed to the substrate by at least one adhesion material selected from the group consisting of adhering, etching and inking materials.

9. The antenna component of claim 1 wherein the length of the driving element is greater than the lengths of the first and second parasitic elements located on each side of the driving element.

10. The antenna component of claim 1 wherein each of the driving element, the first parasitic element and the second parasitic element, have an elongated rectangular shape with all linear sides and with each of the elements being parallel to each of the other elements.

11. The antenna component of claim 1 wherein the substrate further has a thickness between its top surface and its bottom surface, and a side defined therebetween and an edge defined between the top surface and the side, wherein the driving element is electrically coupled to the ground plate at a ground plate driving element connection point via an electrically conducting driving element trace disposed on the side of the substrate, the second end of the first parasitic element being electrically coupled to the ground plate at a ground plate first parasitic element connection point by an electrically conducting first parasitic element trace disposed on the side of the substrate, and the second end of the second parasitic element being electrically coupled to the ground plate at a ground plate second parasitic connection point via an electrically conducting second parasitic element trace disposed on the side of the substrate.

12. The antenna component of claim 1 wherein the substrate having the ground plate disposed on the bottom surface thereof is enclosed within a housing, the housing having an extension member for extending an electrical cable having a first conductor providing the input current signal to the feed point of the driving element, and a second conductor providing a ground to the ground plate via a ground connector.

13. A trident antenna assembly comprising:

a housing configured for selectably mounting to a mounting surface and enclosing the other components of the assembly;

an extension member for extending into a hole in the mounting surface for mounting the housing thereto and for providing an electrical conductor egress into the housing;

an electrical cable having a first conductor providing an input current signal to an antenna element within the housing, and a second conductor providing an earth ground to a ground component within the housing;

a substrate composed of a dielectric material having a top surface and a bottom surface;

a ground plate composed of an electrically conductive material disposed on the bottom surface of the substrate, the ground plate being electrically connected to the second conductor of the electrical cable;

a driving element, first and second parasitic elements, and a feed point, all being disposed on the top surface of the substrate, the driving element, first and second parasitic elements, and the ground plate being formed of an electrically conductive material;

the driving element having an elongated planar shape with a first and second ends and being electrically coupled to the ground plate, first and second linear sides defining a width therebetween, and a driving element length, the driving element also having a feed point to receive an input current signal from the first conductor of the electrical cable;

the first parasitic element having an elongated planar shape with a first and second end, first and second linear sides defining a width therebetween, and a first parasitic length, the first parasitic element being parallel to and set apart from the first linear side of the driving element by a first gap, the first parasitic element being electrically connected to the driving element across the first gap through the dielectric substrate and the second end being electrically coupled to the ground plate;

a second parasitic element having an elongated planar shape with a first and second end and being electrically coupled to the ground plate, first and second linear sides defining a width therebetween, and having a second parasitic length, the second parasitic element being parallel to and set apart from the second linear side of the driving element by a second gap, the second parasitic element being electrically connected to the driving element across the second gap through the dielectric substrate, wherein the second parasitic element length is of a different length than the first parasitic length, the first and second parasitic elements being responsive to the input current signal to generate a dual resonance; and, wherein the driving element, first parasitic element and second parasitic element form the trident antenna arrangement of the assembly; and, wherein there is a differential length between the first parasitic length and the second parasitic length of approximately 0.090 inches which results in dual resonances occurring and further resulting in a nearly uniform return loss that is less 10 dB or less when the trident antenna operates in a frequency range of between approximately 450 MHz to approximately 470 MHz.

14. The trident antenna assembly of claim 13 wherein the substrate comprises a printed circuit board which is attached to the ground plate.

15. The trident antenna of claim 13 wherein one or more of the driving element, the first parasitic element, the second parasitic element, and the ground plate elements is composed of an electrically conductive material selected from the group consisting of copper, brass, or aluminum.

16. The trident antenna of claim 13 wherein one or more of the driving element, the first parasitic element, the second parasitic element, and the ground plate all are disposed to the substrate by at least one adhesion selected from the group consisting of adhering, etching and inking.

17. The trident antenna of claim 13 wherein the length of the driving element is greater than the lengths of the first and second parasitic elements located on each side of the driving element.

18. The trident antenna of claim 13 wherein each of the driving element, the first parasitic element and the second parasitic element, have an elongated rectangular shape with all linear sides and with each of the elements being parallel to each of the other elements.

19. The trident antenna of claim 13 wherein the substrate further has a thickness between the top surface and the bottom surface thereof, a side defined therebetween, and an edge defined between the top surface and the side, wherein the second end of the driving element is electrically coupled to the ground plate at a ground plate driving element connection point via an electrically conducting driving element trace disposed on the side of the substrate, the second end of the first parasitic element being electrically coupled to the ground plate at a ground plate first parasitic element connection point by an electrically conducting first parasitic element trace disposed on the side of the substrate, and the second end of the second parasitic element being electrically coupled to the ground plate at a ground plate second parasitic connection point via an electrically conducting second parasitic element trace disposed on the side of the substrate.

20. The antenna component of claim 19 wherein the substrate having the ground plate disposed on the bottom surface thereof is enclosed within a housing, the housing having an extension member for extending an electrical cable having a first conductor providing the input current signal to the feed point of the driving element, and a second conductor providing a ground to the ground plate via a ground connector.

* * * * *